United States Patent [19]

DeCanto et al.

[11] 4,219,196

[45] Aug. 26, 1980

[54] MATHEMATICS GAME BOARD APPARATUS

[76] Inventors: Joseph F. DeCanto, 2304 Green Acres Dr., Oak Grove, Ky. 42262; Deborah L. Griffey, 2139 Harvill Rd., Clarksville, Tenn.

[21] Appl. No.: 962,287

[22] Filed: Nov. 20, 1978

[51] Int. Cl.[3] ..... A63F 3/00

[52] U.S. Cl. ..... 273/126 R; 273/241; 273/284; 273/139

[58] Field of Search ..... 273/126 R, 248, 142 R, 273/242, 254, 273, 284, 241, 155, 271, 280, 230

[56] References Cited

U.S. PATENT DOCUMENTS

| | | | |
|---|---|---|---|
| 2,219,546 | 10/1940 | Petersen | 273/284 |
| 2,460,264 | 1/1949 | Prentice et al. | 273/284 |
| 2,811,361 | 10/1957 | Woolrich, Jr. | 273/254 |
| 3,008,718 | 11/1961 | Berliner | 273/126 R |
| 3,347,549 | 10/1967 | Jackson | 273/273 |
| 3,871,654 | 3/1975 | Bliss | 273/284 |
| 3,948,527 | 4/1976 | Aguirregomezcorta | 273/284 |
| 3,995,862 | 12/1976 | Berlin | 273/241 |
| 4,002,342 | 1/1977 | Biggs | 273/280 |

*Primary Examiner*—Richard C. Pinkham

*Assistant Examiner*—T. Brown

*Attorney, Agent, or Firm*—Harrington A. Lackey

[57] ABSTRACT

A mathematics game board apparatus including an indicia board having a plurality of indicia spaces including numbers and mathematical function indicia for rotary movement upon a base board, a matching board having a plurality of circular matching openings therethrough and adapted to be rotated independently of and above the indicia board, and a transparent sheet member having a playing surface fixed to the base board above the matching board for supporting at least one playing piece, the position of the playing piece and the rotary positions of the matching board and the indicia board indicating a number upon which a mathematical function is to be performed.

The game board apparatus further includes a rotary registry board mounted concentrically between the matching board and the transparent sheet member and having registry openings identical in number and location to the matching openings, for alternatively concealing and exposing the indicia spaces through corresponding matching openings.

The indicia spaces may be color-coded numbers.

6 Claims, 11 Drawing Figures

MATHEMATICS GAME BOARD APPARATUS

BACKGROUND OF THE INVENTION

This invention relates to a game board, and more particularly to a mathematics game board apparatus.

Rotary game board apparatus of various types are known in the art, some of which involve the performance of mathematical functions.

The following U.S. Pat. Nos. disclose various types of game board apparatus having stationary boards and rotary discs adapted to rotate beneath the stationary boards:

2,811,361—Woolrich, Jr.—Oct. 29, 1957

3,347,549—Jackson—Oct. 17, 1967

3,995,862—Bertin—Dec. 7, 1976

However, the above Woolrich and Jackson patents disclose holes in the stationary board adapted to register with various types of indicia on the rotary disc beneath the stationary board.

SUMMARY OF THE INVENTION

It is an object of this invention to provide a mathematics game board apparatus including a base board, a rotary indicia board on the base board, a rotary matching board having matching openings therein over the indicia board and a transparent sheet member having a playing surface over the matching board and fixed to the base board.

The indicia board has numerous indicia spaces, preferably uniform circular areas, each space including a number and an indicia of a mathematical function to be performed upon said number. Such an indicia space is preferably a color-coded number, the color indicating the function to be performed, such as addition, subtraction, multiplication or division.

The matching openings in the matching board are preferably of the same size and shape as the indicia spaces, but far fewer in number. The matching board is adapted to be rotated relative to the indicia board for exposing portions of different indicia spaces in different positions.

The transparent sheet member supports a playing piece in a chance position for registry with a certain indicia space made visible through a matching opening of a matching board rotated to a position vertically aligned with the playing piece, to determine the number and the mathematical function to be performed upon the number in order to obtain a score for the particular player.

Other game accessories, such as dice, may be employed for a more elaborate performance of the game.

In the preferred form of the invention, the board apparatus also includes a rotary registry board rotably and concentrically mounted above the matching board and below the stationary transparent sheet member. The registry board is substantially identical to the matching board in that it has the same number, size, shape and position of registry openings as the matching openings. The registry board is supported for limited rotary movement relative to the matching board for movement between a registry position, in which all of the registry openings are vertically aligned, or register with, the corresponding matching openings, and a non-registry position for concealing all of the indicia spaces from view. The purpose of the registry board is to conceal all of the indicia spaces from view while the matching board and the indicia board are rotated at random for repositioning the indicia spaces before play begins. After the playing piece is positioned by chance or randomly upon the transparent sheet member by "flicking" or sliding the playing piece into position, then the registry board may be rotated to its registry position to expose the matching openings and the indicia spaces.

DESCRIPTION OF THE PREFERRED EMBODIMENTS

Figure 4:
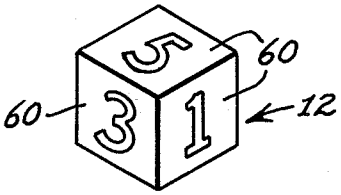
FIG. 4 is a perspective view of a number die for use with the game apparatus.
Figure 6:
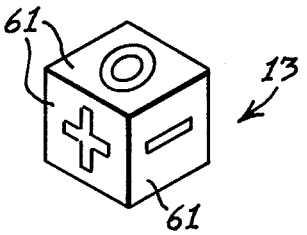
FIG. 6 is a perspective view of an optional die for use with the game apparatus.
Figure 8:
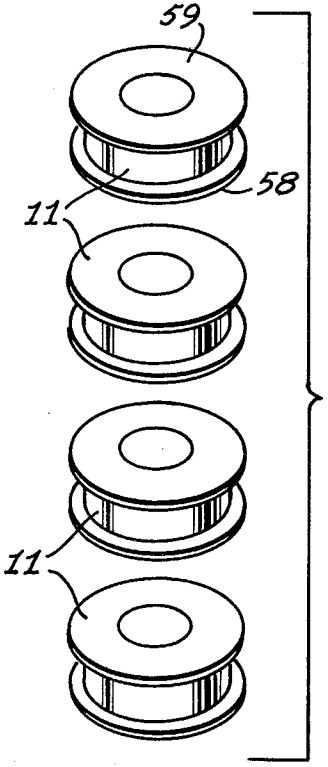
FIG. 8 is a perspective view of four game or playing pieces to be used with the game apparatus.

Referring now to the drawings in more detail, the game apparatus made in accordance with this invention includes a game board apparatus or device 10, one or more playing pieces or game pieces 11, four of which are disclosed in FIG. 8, and preferably a number die 12 (FIG. 4) and an optional die 13 (FIG. 6).

The game board device 10 includes a base board 15, preferably square, to the center of which is attached or fixed an upstanding circular spindle or hub 16. Corner pieces 17 are integrally formed to project upward from each corner portion of the base board 15. Each corner piece 17 has an inner arcuate wall forming circular segments of equal radius to receive the stacked rotary discs or boards, to be described.

Figure 9:
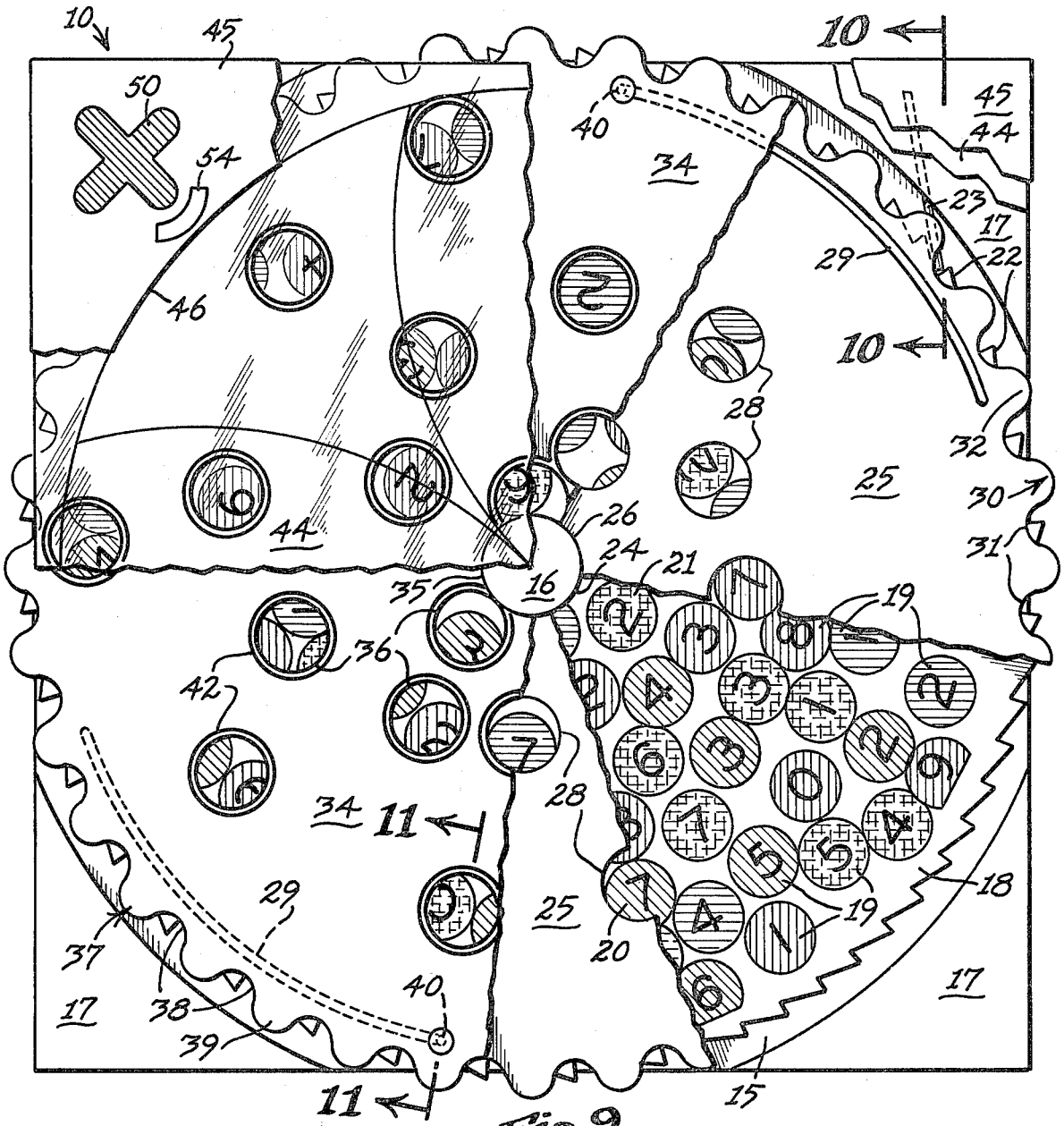
FIG. 9 is a plan view of the game apparatus, with portions broken away to disclose the construction and assembly of the game board apparatus.
Figure 10:
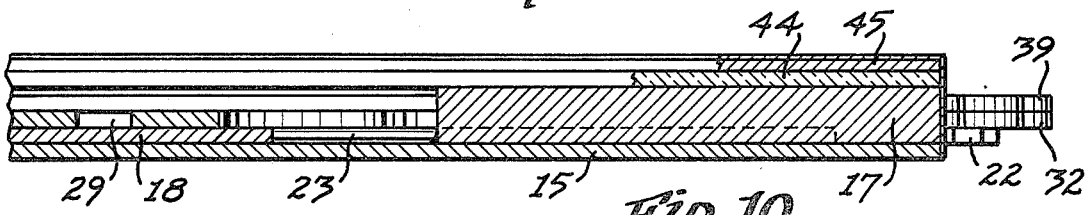
FIG. 10 is an enlarged fragmentary section taken along the line 10—10 of FIG. 9.
Figure 11:
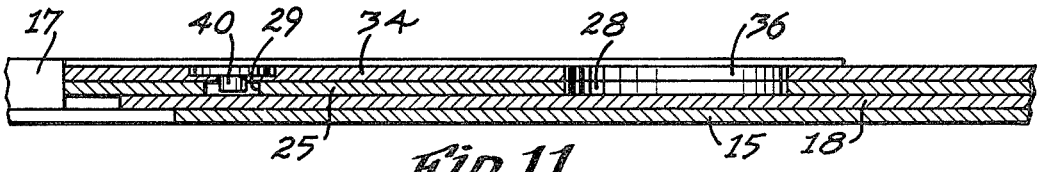
FIG. 11 is an enlarged fragmentary section taken along the line 11—11 of FIG. 9.

Rotably mounted upon the spindle 16 on top of the base board 15 is an indicia board or disc 18, the top surface of which is substantially covered with a plurality of indicia spaces 19. The particular indicia spaces 19 disclosed in FIG. 9 are uniform, circular areas including numbers from 0 to 9 and color-coded in four different colors, red, blue, green and yellow. For example, in FIG. 9 the circular indicia space 20 includes the number 7, and is color-coded green. The indicia space 21 includes the number 2 and is color-coded yellow. The green indicia spaces 19, indicate to the player that the number within that particular space is to be added to the player's previous score. The red indicia spaces 19 indicate to the player that that particular number is to be subtracted from his previous score. The blue indicia spaces 19 indicate to the player that that number is to be multiplied by his previous score. The yellow indicia spaces 19 indicate to the player that he is to divide his previous score by the number within the yellow indicia space 19. For example, the green indicia space 20 indicates to the player that the number 7 is to be added to the player's previous score. The yellow indicia space 21 indicates to the player that his previous score is to be divided by the number 2.

The periphery of the indicia board 18 is serrated to form ratchet teeth 22 adapted to be engaged by a flexible pawl 23 fixed to the upper righthand corner piece 17 disclosed in FIG. 9. The flexible pawl 23 ratchets over the teeth 22 as the indicia board 18 is rotated clockwise to permit free movement of the indicia board 19 over the base board 15. However, any attempt to reverse the rotation of the indicia board 18 counterclockwise will be prevented by the engagement of the pawl 23 with a corresponding tooth 22. Thus, the rotation of the indicia board 18 is unidirectional.

The center of the indicia board 18 is provided with a central bearing hole or opening 24 adapted to rotably receive the hub or spindle 16.

Mounted immediately above the indicia board 18 is a rotary matching board or disc 25 having a central bearing hole 26 adapted to rotably receive the spindle 16. Formed through the matching board 25 are a plurality of circular matching holes or openings 28. The matching holes 28 are substantially fewer in number than the indicia spaces 19, but are preferably of the same size and shape and adapted to register with portions of at least some of the holes in various rotary positions of the matching board 25 relative to the indicia board 15.

In a typical game board 10, there could be 136 circular indicia spaces 19 and 23 matching holes 25.

Preferably formed adjacent to the perimeter of the matching board 25 is an arcuate slot 29 in the form of a circular segment and of limited length.

The perimeter of the matching board 25 is undulated or scalloped to form alternating finger recesses 31 and projections 32.

Rotatably mounted immediately above the matching board is a generally circular registry board or disc 34 having a central bearing hole 35 rotably receiving the spindle 16. The registry board 34 is substantially identical in construction to the matching board 25. The registry board 34 has the same number of registry holes 36 of the same shape, size and position as the matching holes 28, so that when the registry board 34 and the matching board 25 are in the same relative rotary position, that is the registry position, each of the registry holes 36 is in vertical alignment with, or registered with, each of the corresponding matching holes 28.

Furthermore, the diameter of the registry board 34 is the same as the diameter of the matching board 25, and the perimeter 37 of the registry board 34 is undulated to provide identically sized and shaped alternating finger recesses 38 and projections 39 congruent with the scalloped perimeter 30 of the matching board 25.

The only structural differences between the registry board 34 and the matching board 25 is that the registry board 34 is provided with a pair of diametrically opposed depending detents or stop pins 40, each of which is received in a corresponding arcuate slot 29. Thus, the cooperating detent pins 40 and arcuate slots 29 permit relative rotary movement between the registry board 34 and the matching board 25 between a registry position as disclosed in FIG. 9 and a non-registry position.

Each of the registry holes 36 may be encircled by a slightly larger printed target circle 42, to emphasize each of the registry holes 36.

Figure 3:
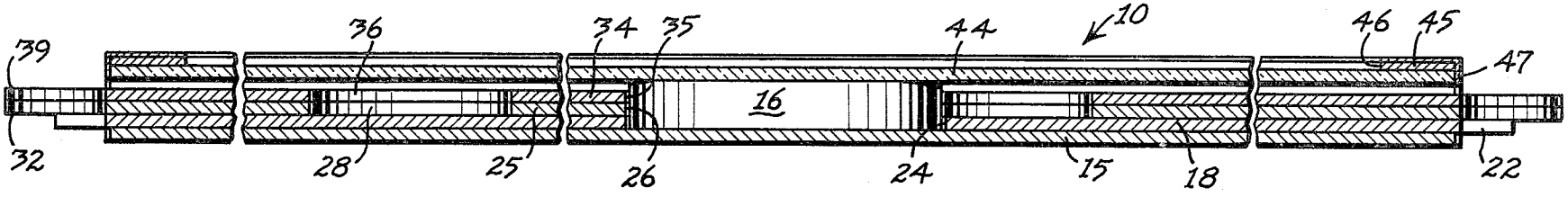
FIG. 3 is an enlarged section taken along the line 3—3 of FIG. 1, with portions broken away.

Supported upon the four corner pieces 17, and preferably being of the same square shape as the base board 15, is a solid transparent playing sheet 44, having a smooth top playing surface, spaced above the registry board 34 and fixed relative to the base board 15. The hub or spindle 16 is preferably of a height sufficient to support the center portion of the playing sheet 44, as best disclosed in FIG. 3.

Fitted over the playing sheet 44 is a cover member 45 having a large circular recess or opening 46 to expose a corresponding circular portion of the playing sheet 44 adapted to support the playing pieces 11. The cover member 45 may have depending side walls 47 projecting down as low as the base board 15, but provided with cut-out recesses 48 to permit the lateral projection of the ratchet teeth 22, the finger projections 32 and the finger projections 39. These wall recesses 48 are formed on all four sides of the game board apparatus 10, so that any of the projecting portions may be manipulated for rotating the respective boards 18, 25 and 34 to any desired rotary position relative to each other and to the base board 15.

The cover member 45 may be integral with the transparent sheet member 44, or the cover member 45 may have a circular transparent sheet portion extending across the entire circular recess 46, if desired.

Figure 1:
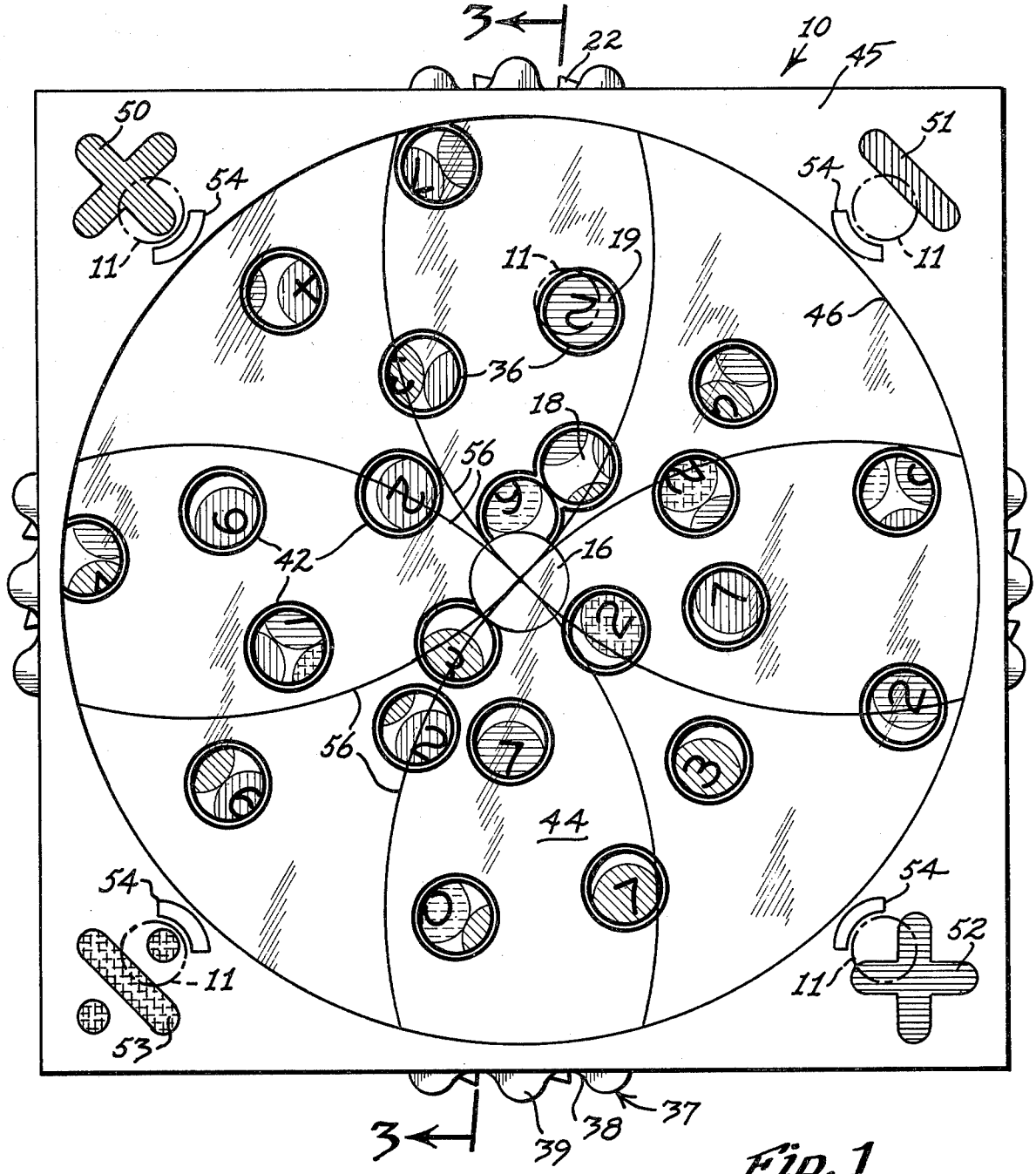
FIG. 1 is a top plan view of the game board apparatus made in accordance with this invention.
Figure 2:
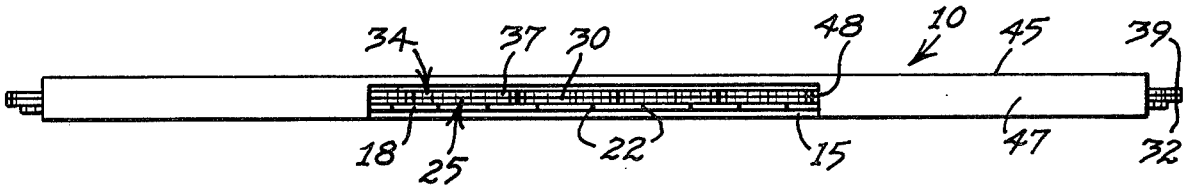
FIG. 2 is an end elevation of the game board apparatus disclosed in FIG. 1.

The cover member 45 may have printed in each corner the respective mathematical or arithmetical symbols, color-coded for the respective functions, such as the green addition sign 50, the red subtraction sign 51, the blue multiplication sign 52 and the yellow division sign 53, as illustrated in FIG. 1.

Spaced inwardly of each arithmetical sign 50–53 is a start line 54.

The transparent playing sheet member 44 may be divided by the circular segmental lines 56 into players' zones in accordance with certain rules of the game.

Each of the playing pieces 11 has a smooth bottom surface 58, and optionally, a smooth top surface 59, to permit the playing piece 11 to slidably move across the low-friction top surface of the playing sheet 44. Each playing piece 11 may be initially positioned upon a start line 54 in the player's corner and "flicked" across the surface of the playing sheet 44 to come to rest in any chance or random position upon the playing sheet 44.

Figure 5:
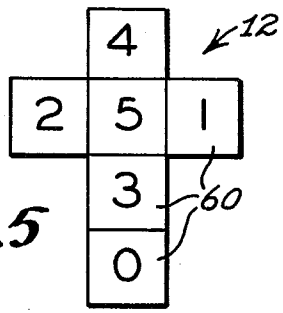
FIG. 5 is a plan view of the blank for making the number die.

Each number die 12 is formed in a cubical shape from a blank having 6 identical square faces 60, as disclosed in FIG. 5, each face having a number consecutively from 0 to 5.

Figure 7:
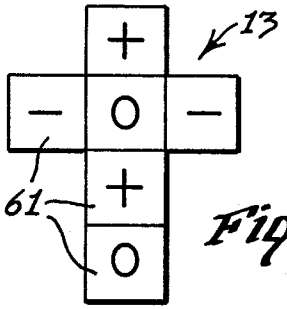
FIG. 7 is a plan view of a blank from which the optional die is made.

Each optional die 13 is also of cubical shape and formed from a blank having six faces 61 as disclosed in FIG. 7. Each pair of opposed faces has a like arithmetical sign, a plus or a minus, or a pair of opposed zeros, as shown in FIGS. 6 and 7.

In order to play a game with the game board apparatus 10, the indicia board 18, the matching board 25, and the registry board 34, are preferably rotated clockwise individually, or together. However, the registry board 34 should be rotated a greater clockwise distance than the matching board 25 so that the registry holes 36 will become disaligned with the matching holes 28 and the matching holes 28 will be covered by the solid portions of the registry board 34, so that all of the colored indicia spaces 19 will be completely concealed from view as the boards or discs are rotated, until they have stopped in a random position.

Play may start by a player "flicking" a playing piece 11 from his start line 54 so that the playing piece 11 slides across the playing surface 44 and comes to rest in a chance or random position upon the playing surface 44. The registry board 34 is then rotated counterclockwise until it is moved to its registry position with respect to the matching board 25, or in other words, when the detents 40 engage the counterclockwise end of each of the arcuate slots 29. In this position, all of the matching holes 28 and the registry holes 36 will be in vertical alignment and in registry to expose the colored surfaces upon the indicia board 18 through the matching holes 28. The registry holes 36 and the matching holes 28 will be continually moved counterclockwise together until a registry hole 36 is in near vertical alignment with the playing piece 11 registering upon the playing sheet 44. The playing piece 11 is then removed and the indicia space 19 immediately below the removed playing piece 11 is visible through the registry hole 36 and aligned matching hole 28. If a green 7, such as indicia space 20, is observed, then the number 7 is added to the player's previous score, since the color code green indicates to the player that the addition function is to be performed.

In the preferred form of playing the game, if the indicia space 19 displays a 0 through the aligned holes 28 and 36, the player has an option of casting the number die 12. Then, the face value of the die 12 is the number upon which the arithmetic function is performed.

The option die 13 is used when the player's score has dropped below 0 and is a negative number. The player then has the option of casting the optional die 13 in order to obtain the face value of a functional sign or a zero, which, according to the preferred rules of the game, will give him a better score than by merely rotating the registry disc 34.

The game is continued by each player taking his turn of "flicking" his playing piece 11 and rotating the registry board 34 and the matching board 25 to line up the indicia space 19 most nearly in vertical alignment with the playing piece 11 to determine the mathematical function to be executed. Play continues until one player has obtained a predetermined maximum score.

What is claimed is:

1. Game apparatus comprising:

(a) a base board having a center, (b) an indicia board having a center and a plurality of indicia spaces substantially covering said indicia board about said center, each indicia space including a number and an indicia of mathematical function, (c) a matching board over said indicia board having a center and a plurality of matching openings therethrough for viewing portions of at least one of said indicia spaces in various relative rotary positions of said matching board and said indicia board, (d) a registry board over said matching board having a center and a plurality of registry openings therethrough identical in number, size, shape and position to said matching openings, (e) rotary mounting means supporting said registry board, said matching board and said indicia board upon said base board for free relative rotary movement of said registry board, said matching board and said indicia board about said center, whereby said registry board may be rotated to a registry position in which said registry openings register with the corresponding matching openings, (f) a transparent sheet member fixed to said base board and disposed over said registry board, (g) at least one playing piece of a size comparable to the size of each opening through said matching board, said playing piece being adapted to be supported on said transparent sheet member.

2. The invention according to claim 1 in which the number of indicia spaces is substantially greater than the number of said matching openings.

3. The invention according to claim 1 in which said indicia spaces are of uniform size and shape and said matching openings are of uniform size and shape.

4. The invention according to claim 1 in which said playing piece is slidable on said transparent sheet member.

5. The invention according to claim 1 comprising means limiting the relative rotary movements of said matching board and said registry board between said registry position and a non-registry position.

6. The invention according to claim 5 in which said limiting means comprises a concentric arcuate slot in one of said registry board or said matching board and a stop pin in the other of said registry board or said matching board, said stop pin being received in said arcuate slot for arcuate movement in said slot.

* * * * *